US005270726A

United States Patent [19]

Axtell et al.

[11] Patent Number: 5,270,726

[45] Date of Patent: Dec. 14, 1993

[54] RECTANGULAR APERTURE REFLECTOR FOR RADAR CROSS SECTION AND ANTENNA PATTERN COMPACT RANGES

[75] Inventors: James C. Axtell, Des Moines; Vernon B. Westburg, Bellevue; Hwai-Kee Tsiang, Edmonds, all of Wash.

[73] Assignee: The Boeing Company, Seattle, Wash.

[21] Appl. No.: 830,508

[22] Filed: Jan. 31, 1992

Related U.S. Application Data

[63] Continuation of Ser. No. 574,011, Aug. 6, 1990, abandoned.

[51] Int. Cl.[5] ..... H01Q 15/160; H01Q 19/120

[52] U.S. Cl. ..... 343/912; 343/914

[58] Field of Search ..... 343/703, 781 R, 840, 343/912, 914; 342/360

[56] References Cited

U.S. PATENT DOCUMENTS

| | | | |
|---|---|---|---|
| H514 | 8/1988 | Burnside et al. | 342/360 |
| 3,302,205 | 1/1967 | Johnson et al. | 343/703 |
| 4,862,188 | 8/1989 | Monvoisin et al. | 343/912 |
| 4,885,593 | 12/1989 | Hess, Jr. et al. | 343/703 |

FOREIGN PATENT DOCUMENTS

| | | | |
|---|---|---|---|
| 0817170 | 7/1959 | United Kingdom | 343/914 |
| 0001159 | 12/1979 | World Int. Prop. O. . | |

OTHER PUBLICATIONS

Pistorius, C. W. I., Ph.D. Dissertation entitled, New Main Reflector, Subreflector and Dual Chamber Concepts for Compact Ranee Applications, Ohio State University 1986 330 pages.

PhD Dissertation by Carl Pistorius, "New Main Reflector, Subreflector, and Dual Chamber Concept for Compacted Range Applications", pp. 72–74, 82, 146.

*Primary Examiner*—Rolf Hille

*Assistant Examiner*—Peter Toby Brown

*Attorney, Agent, or Firm*—Kenneth J. Cooper

[57] ABSTRACT

A compact range system includes a feed antenna offset from the rectangular-aperture paraboloidal reflector. The reflector has blended edges and smoothed corners to reduce contamination of propagated electromagnetic plane waves by diffracted energy. The continuous, smooth surface of the reflector maximizes the purity and uniformity of the plane waves from the reflector.

13 Claims, 9 Drawing Sheets

RECTANGULAR APERTURE REFLECTOR FOR RADAR CROSS SECTION AND ANTENNA PATTERN COMPACT RANGES

This is a continuation of copending application Ser. No. 07/574,011 filed Aug. 6, 1990 now abandoned.

BACKGROUND OF THE INVENTION

Compact ranges are useful in limited space settings for testing the radar cross section of objects and for measuring the patterns of antennas. Such ranges offer cost savings over conventional outdoor range systems requiring a long, unobstructed space between the illuminating source and the illuminated object. Compact ranges offer enclosed testing where conditions can be better controlled than in an outdoor setting.

In typical applications, the target of a radar is located at a distance of many wavelengths from the radar source, such that the target is illuminated by plane waves; a condition known as the "far field". Similarly, objects illuminated by antennas are typically many wavelengths from the antenna, so as to be in the far field of that antenna. When measuring the radar cross section of targets, or when measuring the patterns of antennas, far field conditions must be provided to the maximum extent possible.

A compact range must produce plane waves throughout the volume occupied by the object under test. This "quiet zone" or "target zone" must be uncontaminated by spurious sources of electromagnetic energy arising in the range itself.

One way to construct a compact range is to use a paraboloidal reflector illuminated by a source at the focus of the reflector. However, diffraction from the real edge of the reflector distorts the otherwise plane waves propagated from the reflector and contaminates the quiet zone. The challenge is to develop a reflector which appears, within the region of the electromagnetic spectrum to be used for testing, to have no diffracting edge.

Existing reflectors have included various geometrics to achieve plane wave transmission and reduced diffraction. United Kingdom patent publication 817,170 discloses a conceptual reflector made up of a pair of surfaces separated by a medium. The purpose of the patented reflector is to reflect incident signals in parallel waves. The patent, however, does not specifically describe the geometry of the reflector not the precise edge configuration of the reflector so diffraction is reduced.

Carl Pistorius used his Ph.D. dissertation at Ohio State University in 1986 entitled, "New Main Reflector, Subreflector, and Dual Chamber Concept For Compact Range Applications," to propose an edge treatment to a paraboloidal reflector for propagating plane waves and reducing diffraction. His edge modification technique, called rolled edge blending, generated a contour by continuing the parabolic curvature along lines drawn radially from the vertex of the paraboloid. He then mixed the contour of the parabola with the contour of an ellipse tangent to the parabola at the rim. He blended these shapes to insure a smooth transition between the parabolic curve and the elliptical curve. The Pistorius edge can be described by the formula:

rolled edge = parabola × (1 − blending-function) + ellipse × blending-function where the blending function is a combination of cosine functions. This proposed shape, however, still had the shortcoming of producing a discontinuities in the radius of curvature. Consequently, stray fields from edge diffraction were not totally eliminated.

Pistorius next proposed making the reflecting area of the paraboloid in the form of a rectangular section. He did not discuss how to apply his proposed edge treatment to this rectangular shape. Additionally, Pistorius had no effective design for the corners of the rectangular section of the paraboloid. These corners generated diffracted fields. They seriously contaminated the quiet zone of the reflector. Yet for many applications, a rectangular shape is attractive.

The deficiencies in existing reflector shapes were the incentives for developing the geometry of the applicants' invention.

An object of the invention is to provide a reflector which produces plane waves for a compact range. A second object is to provide a design for a compact range reflector which reduces electromagnetic contamination by diffraction.

Features of the invented rolled edge paraboloidal reflector are the offset rectangular-aperture with blended, rolled edges and shaped corners which are mathematically continuous in all directions with the paraboloidal surface.

The advantage of the invention is the reflector allows objects to be tested for their radar cross section, or antenna patterns to be measured, in a compact range with results which duplicate the electromagnetic illumination in the operating environment.

SUMMARY OF THE INVENTION

A compact range system includes a feed antenna and an offset rectangular-aperture paraboloidal reflector. The reflector has a paraboloidal surface with blended, rolled edges and shaped corners. These corners are mathematically continuous with the surface of the reflector. The reflector accepts electromagnetic energy from the feed antenna, collimates it into plane waves uncontaminated by diffraction, and propagates those wide bandwidth plane waves to the quiet zone where they illuminate the article under test. Scattered and reflected energy from the article under test is then collected by the reflector, uncontaminated by reflector diffraction, and focused on the feed antenna.

DESCRIPTION OF THE PREFERRED EMBODIMENT

Figure 1:
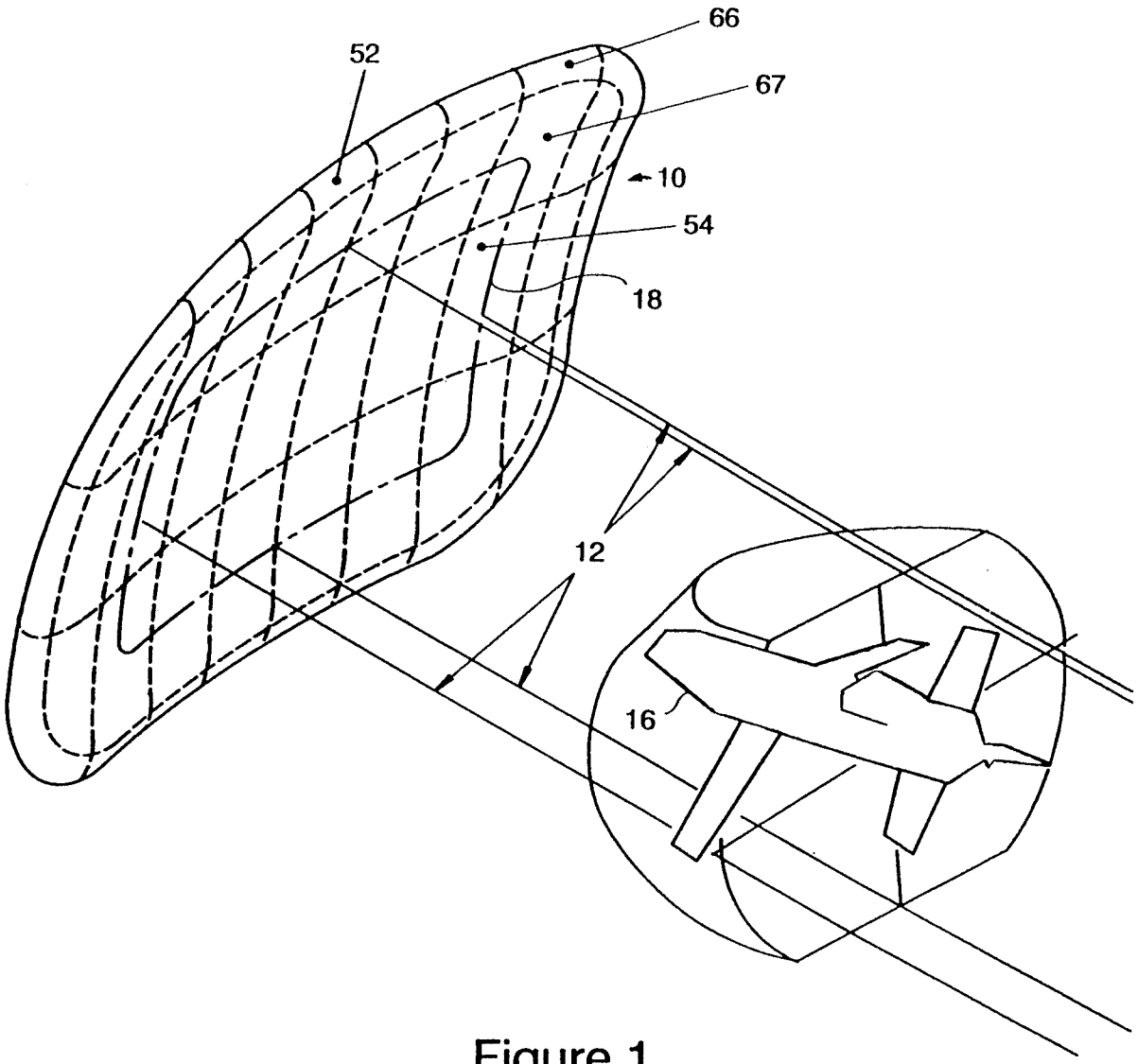
FIG. 1 shows the shape of the reflector, blended and rolled edge, and shaped corners of the invention with an article under test, emplaced in the quiet zone of the reflector, illuminated by reflected electromagnetic energy from the reflector.

The invention is an offset, rectangular-aperture paraboloidal reflector 10 (FIG. 1) with blended rolled edges and smoothly contoured corners.

The paraboloidal portion of reflector 10 (FIG. 2) propagates plane waves 12 originating at feed antenna 14 and reflecting off reflector 10. The plane waves 12 impinge upon an illuminated object 16. The plane waves 12 scatter or reflect from object 16 and are focused by reflector 10 onto feed antenna 14. The feed antenna acts as a receiver to translate the reflected waves to characterize the object 16. Reflector 10 is off-axis so feed antenna 14 can be located out of the path of plane waves 12. The collimating action of reflector 10 defines a quiet zone 18 which contains the object-illuminating plane waves 12. The reflected waves contain the information signals which allow characterization of the object 16. The edges 19 of the paraboloidal surface diffract energy that also illuminates the object 16. This unwanted, diffracted energy contaminates the desired plane wave illumination 12, destroying the duplication of the far field environment.

The paraboloidal portion of the reflector 10 (FIG. 3) is generated by constructing a rectangular aperture cut off-axis from a paraboloid of revolution, as follows. In FIG. 4, point 20 is the vertex of a horizontal parabola 22 that is the generator of a paraboloid of revolution. Vertical parabola 24 originates at point 20 and is identical in shape to horizontal parabola 22. Horizontal parabola 22 lies in horizontal plane 26. Vertical parabola 24 lies in vertical plane 28 that passes through point 20, is perpendicular to horizontal plane 26, and contains the line 30 that is directed from point 20 to the focus of the paraboloidal reflector 10 (FIG. 1). These planes define a coordinate system that contains arbitrary points 32, 34, and 36, (FIG. 4) constrained only by the requirement that they lie on the parabolic edge of either horizontal plane 26 (point 32) or vertical plane 28 (points 34 and 36). Vertical plane 38 is generated by moving plane 28 parallel to itself until point 20 coincides with point 32. In the process of moving, the parabolic edge of vertical plane 28 sweeps out a surface that contains point 34 moving to point 40 and point 36 moving to point 42. Horizontal plane 44 is now defined by the line which is the trajectory of point 34 as it moves to reach point 40. Vertical plane 46 is generated by sweeping plane 28 parallel to itself until point 20 reaches the stopping place, point 48. Horizontal plane 50 is defined by the trajectory of point 36. By construction, the parabolic edges of planes 28, 38, and 46 are identical parabolas.

The process is now re-done by sweeping plane 26 parallel to itself from point 20 to points 34 and 36 to leave parabolas that pass through those points. These parabolas define planes 44 and 50 which are identical with the same identified planes in the previous process. These parabolas are identical to curve 22 by definition, and since they cut plane 38 at points 32, 40, and 42, they are identical to curve 24.

The above demonstration is generalized by the statement: if a paraboloid of revolution is cut by any plane that lies parallel to the line between the vertex and the focus, and locus of the intersection is a parabola that is identical to the parabola that generated the paraboloid of revolution. Furthermore, if two such parallel planes are passed through the paraboloid of revolution, whether containing the vertex or not, all planes perpendicular to those two, and similarly held parallel to the line joining the vertex and the focus, will cut identical parabolic curves from the paraboloid of revolution.

Figure 4:
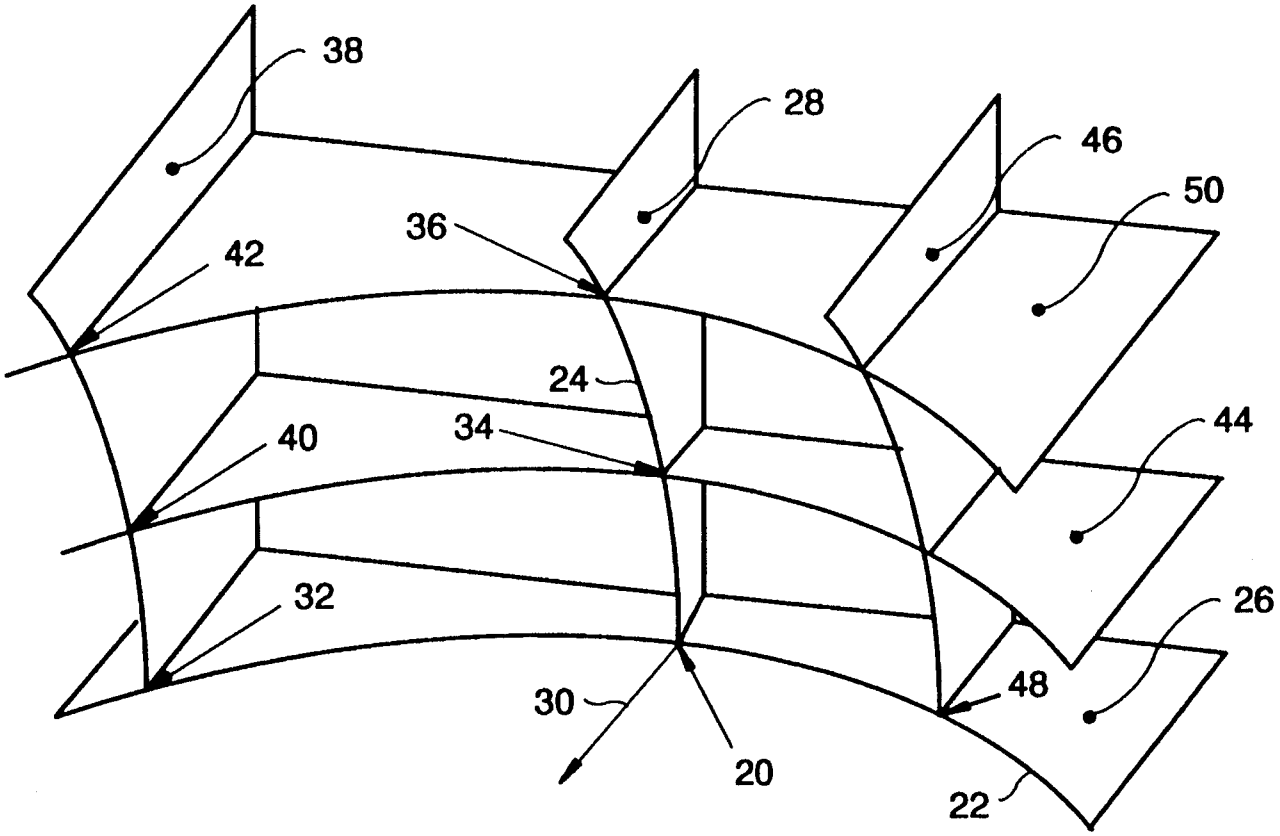
FIG. 4 shows the development of a rectangular section of a paraboloid.
Figure 5:
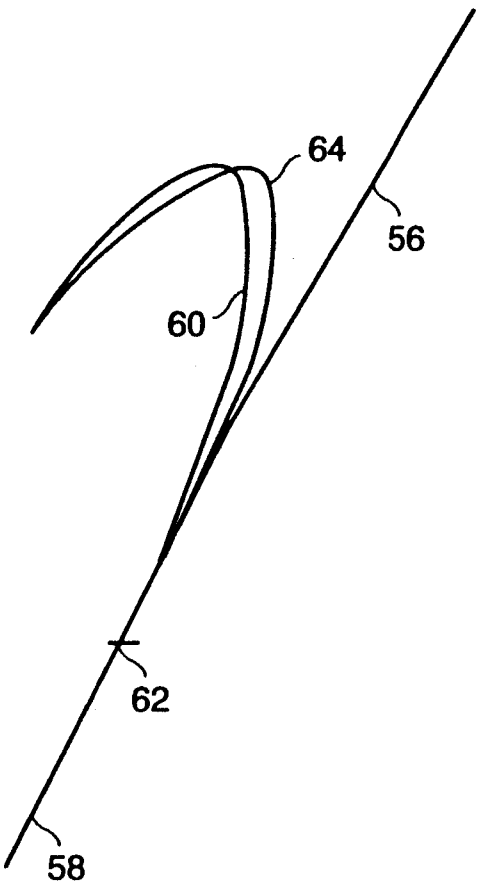
FIG. 5 shows the manner in which edges blend with parabolas.
Figure 6:
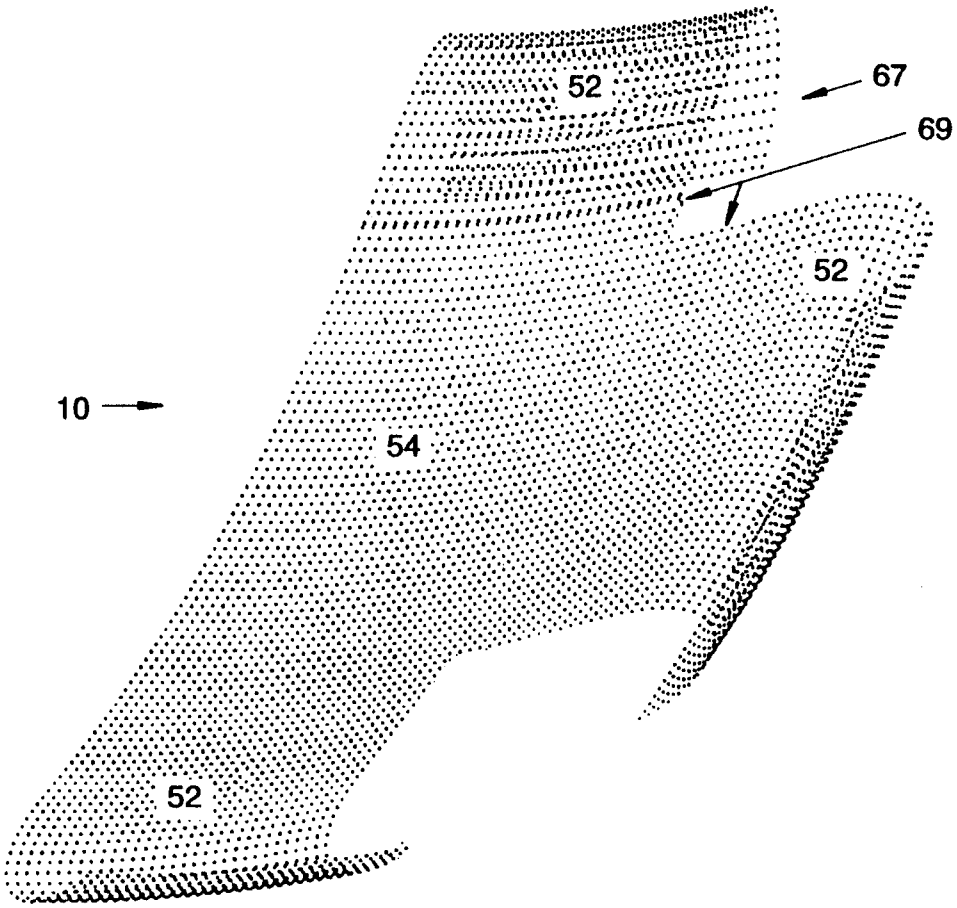
FIG. 6 shows the reflector with generated smooth edges.

The edges 52 (FIG. 1) of reflector 10 are blended with rectangular center portion 54 to eliminate diffraction 19 (FIG. 2) and contamination of quiet zone 18. The rolled blended edges of 52 (FIG. 3) are constructed by mixing the parabolic curve 56 of FIG. 5, which is a continuation of the generator of the paraboloid of revolution 58, with an ellipse 60 that is tangent to the parabola at point 62. Using the mixing formula rolled
edge = parabola × (1 − blending-function) + ellipse × blending-function where the blending function is a cosine-squared function, the rolled edge curve 64 is constructed. Recognizing base parabola 58 is identical with parabola 24 of FIG. 4, and performing a similar rolled edge construction on a lower portion of parabola 24, the rolled edge curve 64 (FIG. 5) is swept in the horizontal direction, as described above, to generate the vertical portion of edge 52 of FIG. 6. In like manner, edges 52 are added to parabola 22 of FIG. 4, and the whole swept in the vertical direction to generate the horizontal wings of FIG. 6.

Figure 2:
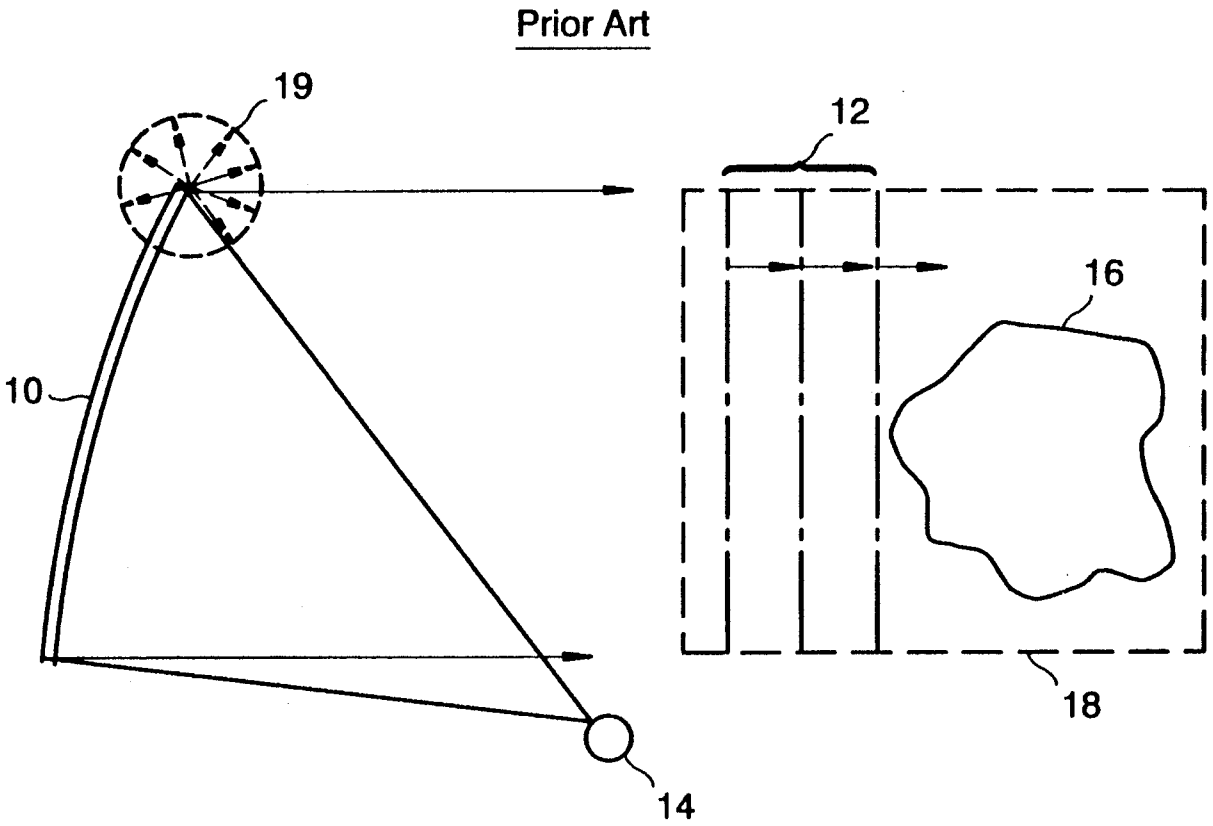
FIG. 2 conceptually represents the arrangement of a feed antenna, reflector, illuminated object, and propagated electromagnetic field plane waves.

Past reflectors have used various degrees of blended edges, but those reflectors still had contaminated quiet zones from plane waves diffracted by the corner portions of the reflector. Those past corner portions could not be made smooth or continuous enough with the reflector and edges. The invention overcomes the corner shortcoming of previous reflectors by adding shaped corners 66 (FIG. 1) having no discontinuities at the junctions between the edges 52 and center 54. The reflector 10 has no ridge on the side of reflector 10 facing feed antenna 14 (FIG. 2).

Figure 3:
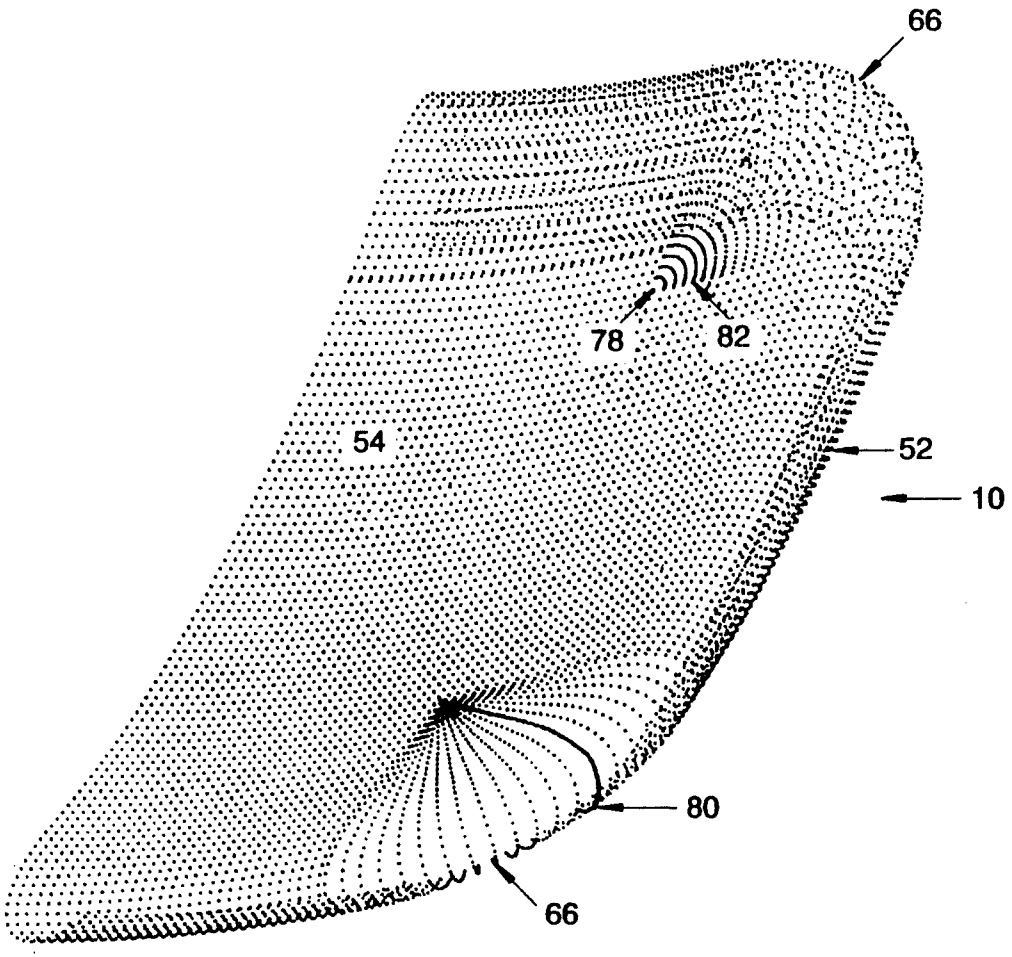
FIG. 3 shows a section of the reflector, blended and rolled edges, and shaped corners of the invention.
Figure 7:
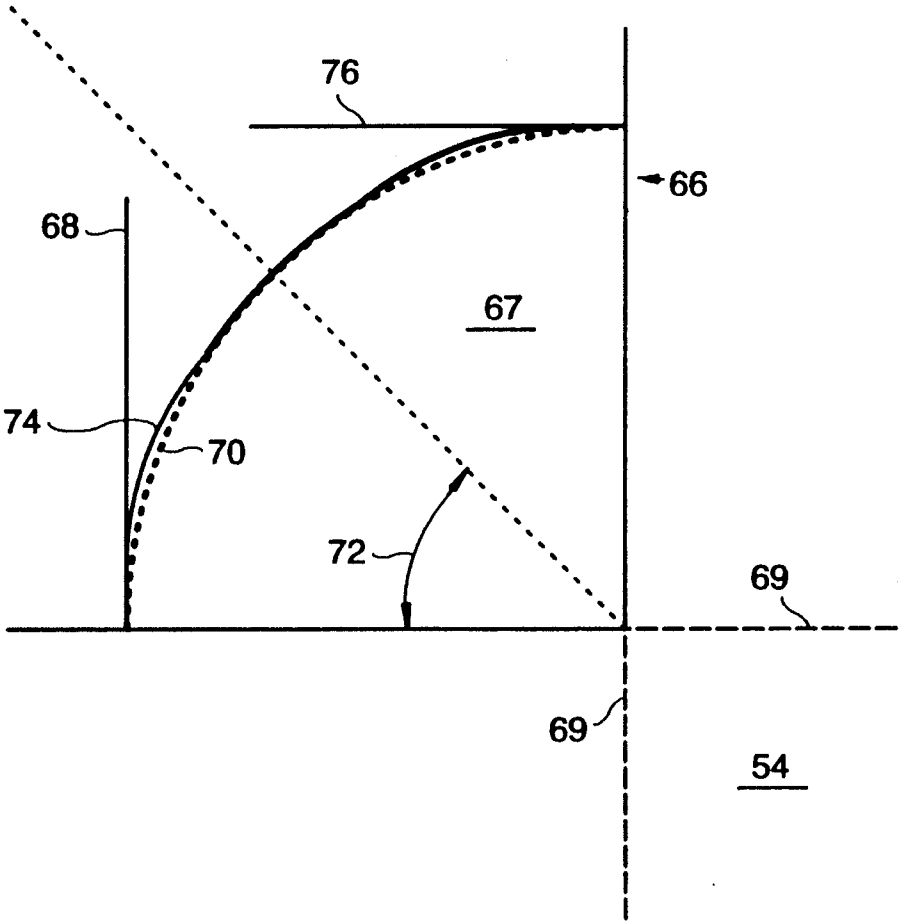
FIG. 7 shows the manner in which corners blend with edges.

Corners 66 are shaped as shown in FIG. 3. Each corner 66 sweeps the area 67 (FIG. 6) between one of the lines 69 extending from one of the four sides of the rectangular center portion 54 and the adjacent line 69 extending from the adjacent side of the rectangular center portion 54. Each corner 66 (FIG. 3) extends outward to the blended rolled edge 52 so the swept area includes no ridge on the side of the reflector 10 (FIG. 1) facing feed antenna 14 (FIG. 2). FIG. 7 further defines corners 66. Vertical line 68 is blended with circle-fraction 70, as defined by angle phi 72, to produce circle-contour 74, according to the formula:

circle-contour = vertical
line × S × B + circle-fraction × (1 − B) for
0 < angle < phi.

The circle-contour is continued until it meets the horizontal line 76 according to the formula:

circle-contour = horizontal
line × S × B + circle-fraction × (1 − B) for
phi < or = angle < or = pi/2

These formulas use "S" as a "speed" factor not greater than 1.0 but always greater than zero, and "B" as the blending function. The speed factor, S, causes more or less of the straight line to be blended, as it is nearer or further from unity. The "circle-fraction" defines that portion of a circle required to join the two straight lines that represent the tangents to the circle 70 subtended by the angle phi. The full circle-contour joins the edges 52 (FIG. 1) of the surface of reflector 10.

The blending function "B" to be used in these formulas must have the first two mathematical derivatives different from zero and be continuous with no double-valued discontinuities in the second derivative. The function must also generate zero as one of the values. The trigonometric sine function satisfies these requirements. The choice of sine functions permits the use of an angle as a parameter in the formula for generating the vertical and horizontal circle contours.

The blending function, "B", increases from zero to one as the angle moves from zero degrees to pi/2. This change causes the circle contour to move from a straight line to a circle and back to a straight line to smoothly join the edges 52 of reflector 10.

The radial shape of corners 66 (FIG. 1) is formed by passing a plane through origination point 78 (FIG. 3), containing any radial line 80, and parallel to the line joining the vertex and the focus of the paraboloid generating reflector 10. On this plane, and passing through center 78, is drawn the locus of all the intersections of the circle-contours 82 with the plane. This locus is continuous in both shape and curvature and blends smoothly to the parabola that is generated by the same plane cutting the paraboloid which generated reflector 10.

The two sets of intersecting curves, those represented by circle-contours 82 and those represented by the loci of intersections along radial lines 80, define the shaped corners 66.

The entire surface of reflector 10 is made electrically conductive either by fabrication from an electrically conductive material or by depositing an electrically conductive surface on a reflector made of an electrically non-conductive material.

Figure 8:
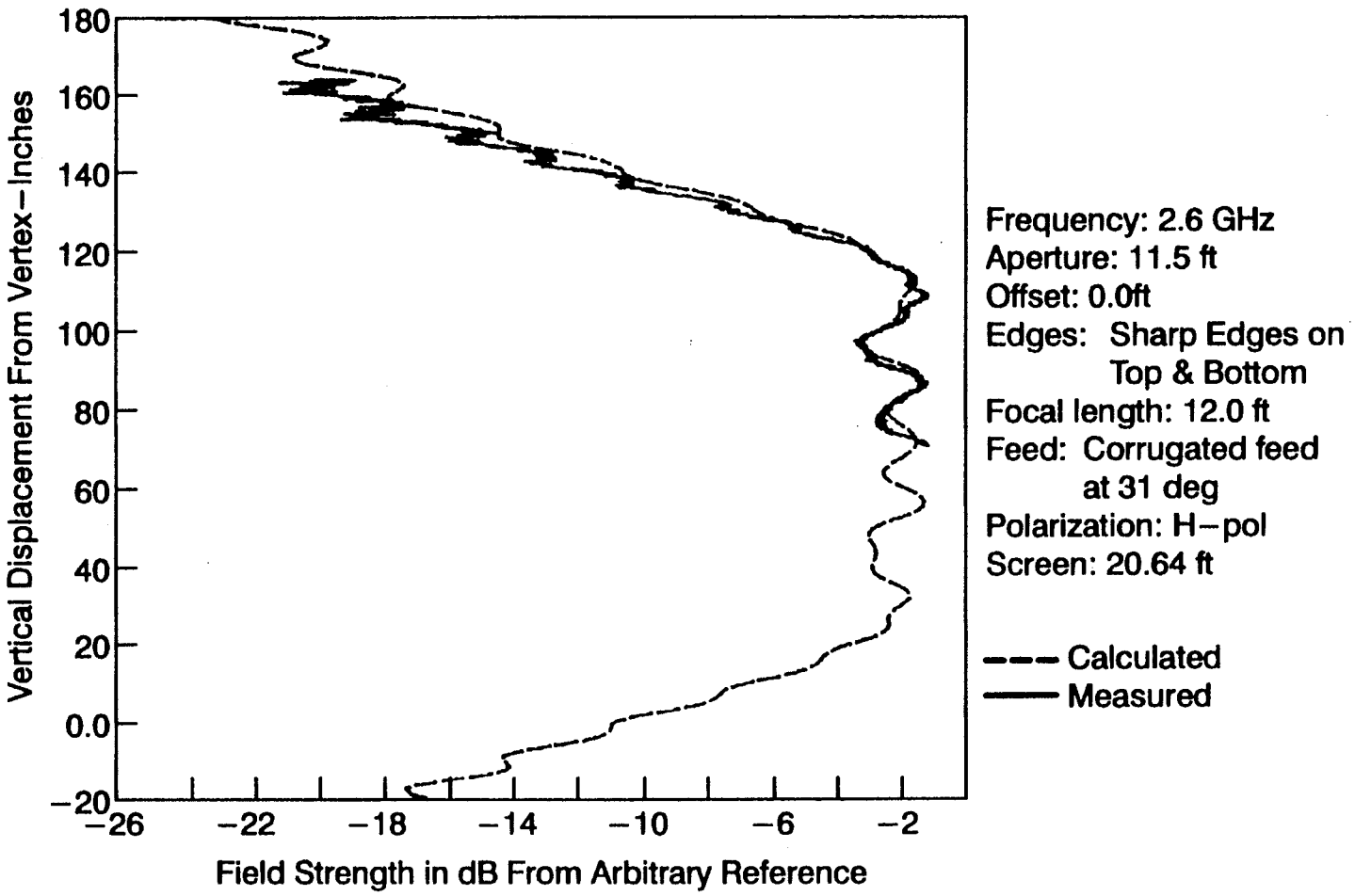
FIG. 8 shows test results of an illuminated reflector having sharp edges and discontinuous corners.
Figure 9:
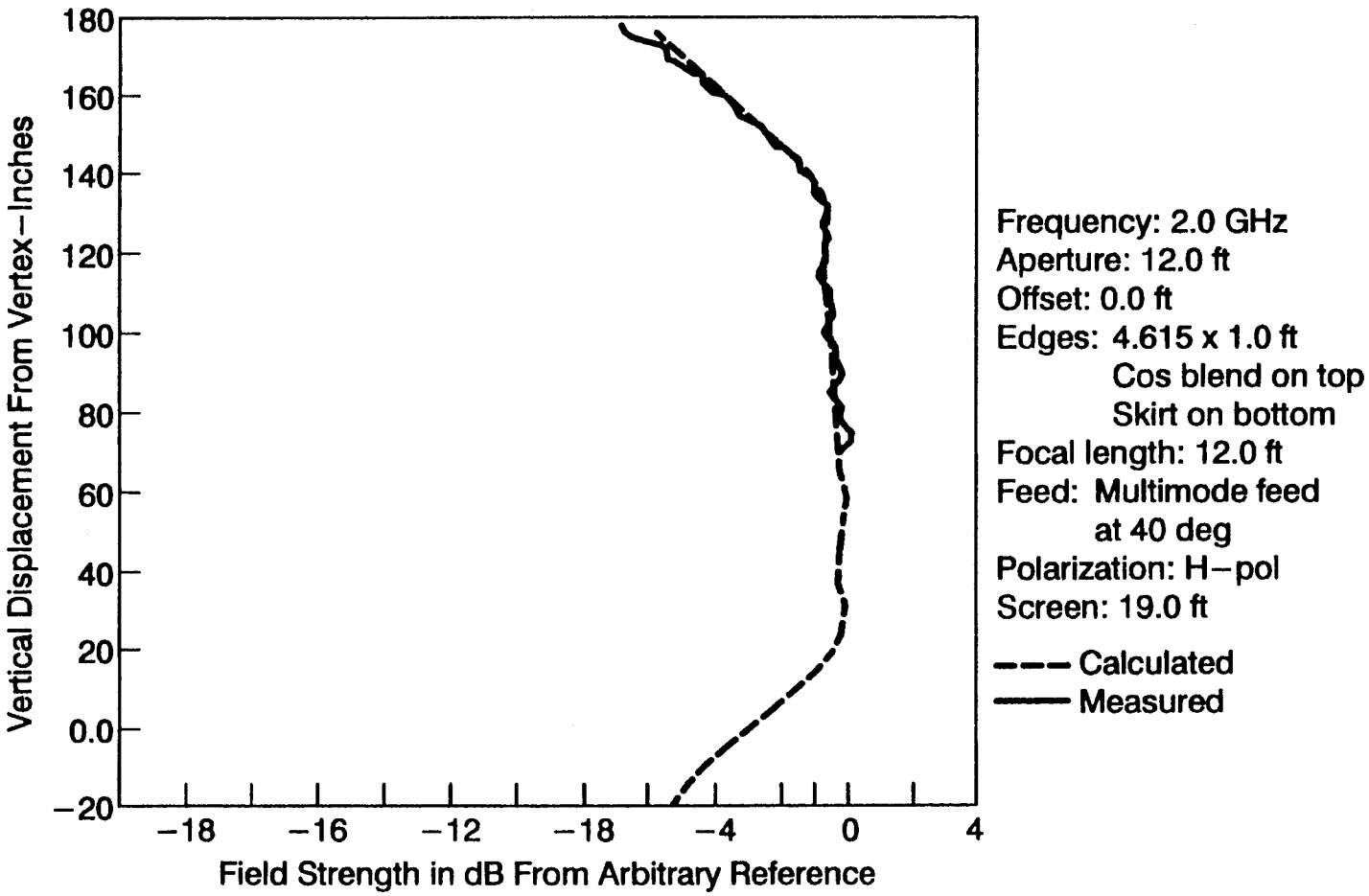
FIG. 9 shows test results of an illuminated reflector having the invention's blended edges.

Test results show reflector 10 yields better signals than past reflector shapes. FIG. 8 shows the voltage variation of the electromagnetic field produced by a paraboloid with a sharp edge exposed to a frequency of 2.6 GHz. The dotted line in FIG. 8 shows the close correlation between the measured and the calculated value of the electromagnetic field produced by the same edge configuration at the same frequency. FIG. 9 shows the voltage along the same vertical line in the electromagnetic field produced by a 2.0 GHz signal impinging on the reflector of FIG. 1 having the invention's blended edges and shaped corners. The measured voltage, shown by the solid line, corresponds closely to the theoretical ideal response.

The rectangular paraboloidal reflector 10 (FIG. 1) with the blended edges 52 and shaped corners 66 most efficiently produces a high quality electromagnetic field of plane waves 12 having a rectangular quiet zone 18 with the smallest total area of reflector surface. Consequently, the cost of propagating the desired plane waves is minimized by the invention's shape.

We claim:

1. A compact range system comprising:

an electromagnetic energy feed antenna; and an offset rectangular-aperture paraboloidal reflector illuminated by the feed antenna, the reflector having a surface with no ridges on the side of the reflector facing the feed antenna, the surface further defined by:

a rectangular center portion having four sides;

a blended rolled edge extending outward from the four sides wherein the outer periphery of the edge has no ridge on the side of the reflector facing the feed antenna and a plurality of corner regions joining adjacent sides of, and extending from, the rectangular center portion to the blended rolled edge, each corner region defined by lines extending outward from the sides of the rectangular center portion immediately adjacent to the junction of the adjacent sides and extended outward to the blended rolled edge, each corner sweeping an area between one of the lines extending from one of the four sides of the rectangular center portion and the adjacent line extending from the adjacent side of the rectangular center portion extended outward to the blended rolled edge so that the swept area includes no ridge on the side of the reflector facing the feed antenna.

2. The compact range system of claim 1, wherein the surface of the reflector, comprises a rectangular, maximum area, within the reflector, which reflects electromagnetic waves from the feed antenna in plane waves without contamination by diffracted electromagnetic energy from the blended rolled edge and shaped corners of the reflector.

3. The compact range system of claim 2, wherein the reflector is offset so the feed antenna does not interfere with the reflected electromagnetic waves.

4. The compact range system of claim 1, wherein the rectangular center portion, blended rolled edge, and corner regions are electrically conductive.

5. The reflector of claim 1, wherein the surface, blended rolled edge, and corner regions are electrically conductive.

6. The compact range system of claim 3, wherein the reflector generates wide bandwidth plane waves of electromagnetic energy.

7. The compact range system of claim 6, wherein the feed antenna is located at the focus of the offset rectangular-aperture paraboloidal reflector.

8. A method of reducing defracted energy and propagating wide bandwidth plane waves from an electromagnetic signal source, the method comprising the steps of:

forming an offset rectangular-aperture paraboloidal reflector surface having mutually perpendicular parabolic edges with no ridges on the side of the reflector facing the electromagnetic signal source, the surface further formed by:

a rectangular center portion having four sides;

a blended rolled edge extending outward from the four sides wherein the outer periphery of the edge has no ridge on the side of the reflector facing the electromagnetic signal source; and a plurality of corner regions joining adjacent sides of, and extending from, the rectangular center portion to the blended rolled edge, each corner region defined by lines extending outward from the sides of the rectangular center portion immediately adjacent to the junction of the adjacent sides and extended outward to the blended rolled edge, each corner sweeping an area between one of the lines extending from one of the four sides of the rectangular center portion and the adjacent line extending from the adjacent side of the rectangular center portion extended outward to the blended rolled edge so the swept area includes no ridge on the side of the reflector facing the electromagnetic signal source.

9. The method of claim 8, wherein forming the offset rectangular-aperture paraboloidal reflector surface comprises cutting off-axis a rectangular aperture from a paraboloid of revolution generated by a selected parabola.

10. The method of claim 9, wherein forming the offset rectangular-aperture paraboloidal reflector surface comprises sweeping the selected parabola along a perpendicular parabolic path shaped identically as the selected parabola.

11. The method of claim 8, wherein the blended rolled edge is formed by sweeping in horizontal and vertical directions a parabolic curve mixed with an ellipse according to the mixing formula:

rolled edge = parabola × (1 − blending function) + ellipse × blending function; where the blending function is a cosine-squared function.

12. The method of claim 8 wherein the corner regions are formed by a vertical line blended with a circle-fraction as defined by angle phi, to produce a circle-contour according to the formula:

circle-contour = vertical line × S × B + circle-fraction × (1 − B) for 0 less than angle less than phi; and continuing circle-contour to a horizontal line according to the formula:

circle-contour = horizontal line × S × B + circle-fraction × (1 − B) for phi less than or equal to angle less than or equal to pi/2 where S is a speed factor not greater than 1.0 but always greater than 0 and B is the blending function.

13. The method of claim 8, wherein forming the offset rectangular-aperture paraboloidal reflector surface comprises coating the reflector with an electrically conductive material.

* * * * *